US005115819A

United States Patent [19]

Wochnowski

[11] Patent Number: 5,115,819

[45] Date of Patent: May 26, 1992

[54] METHOD OF HOMOGENIZING THE CONSTITUENTS OF A TOBACCO STREAM

[75] Inventor: Waldemar Wochnowski, Hamburg-Meiendorf, Fed. Rep. of Germany

[73] Assignee: Körber AG, Hamburg, Fed. Rep. of Germany

[21] Appl. No.: 629,998

[22] Filed: Dec. 19, 1990

[30] Foreign Application Priority Data

Dec. 27, 1989 [DE] Fed. Rep. of Germany ..... 3943085

[51] Int. Cl.[5] ..... A24B 1/04

[52] U.S. Cl. ..... 131/109.3; 131/108; 131/312; 366/108

[58] Field of Search ..... 131/108, 109.3, 312, 131/290; 366/108-111, 154, 212, 240

[56] References Cited

U.S. PATENT DOCUMENTS 2,796,066 9/1955 Creuzburg ..... 131/108
2,801,773 8/1957 Vitkin ..... 366/108 X
4,616,663 10/1986 Lorenzen et al. ..... 131/109.3
4,991,598 2/1991 Henderson et al. ..... 131/312 X

FOREIGN PATENT DOCUMENTS 1072171 6/1960 Fed. Rep. of Germany .
846792 8/1960 United Kingdom .

*Primary Examiner*—V. Millin
*Assistant Examiner*—J. Doyle
*Attorney, Agent, or Firm*—Peter K. Kontler

[57] ABSTRACT

An inhomogeneous stream of tobacco particles is homogenized by feeding the stream onto a vibrating support having openings through which the particles descend onto a conveyor serving to transport the thus homogenized stream in a direction counter to that of advancement of the inhomogenized stream toward and on the support. The homogenizing operation can be repeated by positioning a second vibratory apertured support to receive the once homogenized stream from the conveyor and by positioning a second conveyor beneath the second support.

11 Claims, 1 Drawing Sheet

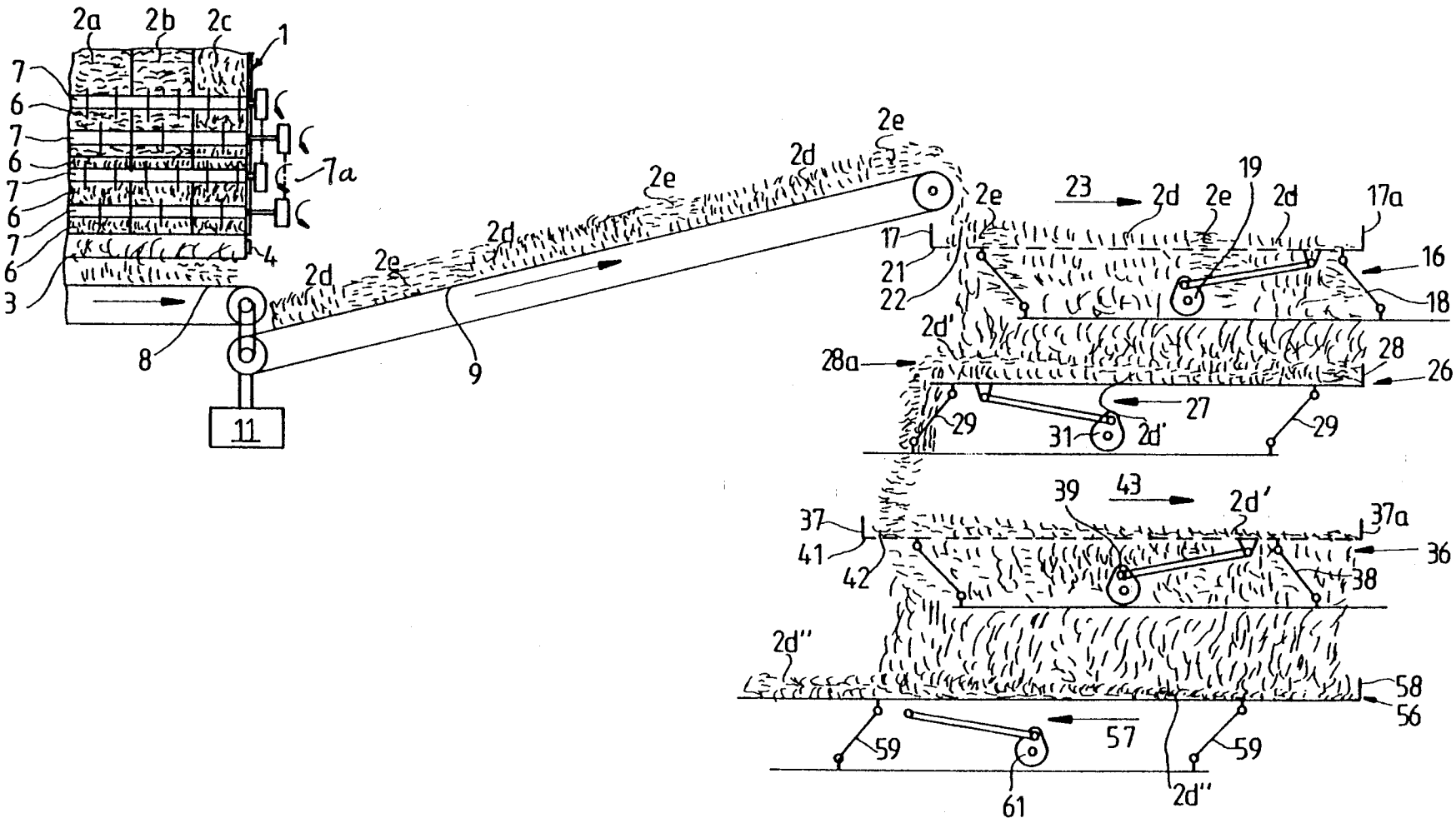
1
2a
2b
2c
7
6
3
4
7a
8
11
9
2d
2e
17
17a
16
18
19
21
22
23
26
28
28a
29
27
2d'
31
36
37
37a
38
39
41
42
43
57
58
56
59
61
2d''

METHOD OF HOMOGENIZING THE CONSTITUENTS OF A TOBACCO STREAM

BACKGROUND OF THE INVENTION

The invention relates to improvements in methods and apparatus for treating tobacco, and more particularly to improvements in methods of and in apparatus for homogenizing inhomogeneous accumulations (particularly piles, stacks or streams) of tobacco parts.

A mixture of tobacco parts which are to be processed into the fillers of cigarettes or into other smokers' products can contain a large number of (up to thirty) different tobacco parts. Tobacco parts can be classified in a number of different ways, such as by origin (e.g., Burley, Virginia and Oriental), by previous treatment (e.g., with or without flavoring agents), by size (such as tobacco leaf laminae and tobacco ribs or stem), by quality (such as natural tobacco leaves, fragments of foils or sheets of reconstituted tobacco and substitute tobacco) and/or in many other ways. A tobacco stream which is to be converted into the filler of a cigarette rod normally contains Virginia and/or Burley and/or Oriental tobacco and/or relatively small quantities of other tobaccos, and such stream can consist of shredded tobacco leaf laminae in the form of long and short shreds. In addition, the stream can contain fragments of puffed (expanded) tobacco ribs. Small quantities of tobaccos other than Virginia, Burley and Oriental are added to certain tobacco streams in order to influence the taste of tobacco smoke in a desired or special way.

Various constituents of a tobacco stream which is to be converted into a tobacco filler or into another smokers' product can greatly influence the taste, aroma as well as filling power of smokers' products. For example, depending upon their composition, the filing power of two tobacco streams can differ by as much as 80 percent. On the other hand, the filling power exerts a pronounced influence upon the quality of smokers' products. For example, the filling power of cigarettes can be a deciding factor (as far as the quality and acceptability of cigarettes is concerned) if tobaccos having different filling powers are used to turn out cigarettes having identical weights. In addition to filling power, homogeneousness of a tobacco stream is another important factor which must be taken into consideration in determining the quality of smokers' products. Thorough intermixing of all kinds of tobacco parts in a stream is desirable and advantageous in order to ensure that the characteristics of each of a short or long series of successively produced cigarettes will be identical or at least nearly identical. Homogeneousness or inhomogeneousness of a tobacco stream which is to be converted into the filler of a cigarette rod greatly influences the taste and hence the quality of cigarettes.

To summarize, two very important prerequisites for the making of smokers, products (e.g., cigarettes) of predetermined quality are satisfactory homogeneousness of the stream and satisfactory filling power. The importance of satisfactory homogeneousness will be readily appreciated by bearing in mind that even minor deviations of homogeneousness from a prescribed norm of a tobacco filler in a cigarette weighing between 700 and 1000 milligrams can entail readily detectable and highly undesirable departures from acceptable quality.

In spite of the aforedescribed importance of homogeneousness of a tobacco stream which is to be converted into the filler of a cigarette rod or into other smokers' products, heretofore tobacco mixing or homogenizing apparatus are far from satisfactory. For example, if tobacco parts are mixed in a standard long mixer (called silo) wherein layers of tobacco (e.g., layers having a width and length of 40 centimeters each) are placed next to and/or on top of each other on a mobile support to be engaged by a system of rakes which move up and down and transfer tobacco parts onto a conveyor, the quality of the mixture on the conveyor is often highly unsatisfactory and never entirely satisfactory. The combined width of several tobacco layers on the mobile support can be in the range of up to 3 meters, and the combined height of such plural layers can be in the range of up to and more than 1.5 meters. When the system of rakes is set in operation to remove tobacco particles from the front face of the assembly of tobacco layers on the mobile support, the elements of the raking system are likely to remove clumps, tufts or bunches of tobacco particles of the same type, i.e., the conveyor which receives the raked off tobacco parts carries an inhomogeneous tobacco stream. For example, if the assembly of tobacco layers contains a relatively small quantity of a particular tobacco type, particles of such particular type are likely to be admitted into the continuously moving stream at or close to 8-second intervals. Thus, the homogeneousness of the tobacco stream on the conveyor which serves to transport the tobacco stream to the next processing station (e.g., into a shredder) is highly unsatisfactory since the aforediscussed tobacco of a particular type will be present only in certain spaced-apart portions of the continuously moving stream. The homogeneousness of tobacco which forms the stream is not enhanced during further processing or is enhanced only to a very small or negligible extent. In other words, the aforementioned tufts, clumps or bunches of particles of the same type of tobacco are not spread out and distributed in the entire tobacco stream. Some mixing is likely to take place during treatment of tobacco particles in drums, driers, flavoring apparatus and certain other units through and/or on which the particles of tobacco must advance on their way toward the rod forming station in a cigarette making machine. Such minor mixing is not sufficient to ensure absolute or even substantial homogeneousness of tobacco in the stream prior to conversion into a rod-like filler.

The art is replete with disclosures of and proposals for machines and apparatus which can be utilized to homogenize accumulations of tobacco and/or other fibrous materials. However, presently known homogenizing machines and apparatus are not designed to spread out (i.e., to distribute) smaller accumulations (bunches, clumps or tufts) of particles of fibrous material in a manner which is acceptable for optimum treatment of tobacco in a cigarette rod making or a like machine. The reason is that heretofore known homogenizing apparatus operate on the principle of comminuting the material which, in the treatment of tobacco, is likely to be more harmful than beneficial as far as the ultimate products are concerned. Therefore, the makers of cigarettes and other smokers' products prefer to avoid the utilization of machines or apparatus which can promote homogenization but are likely to produce substantial quantities of so-called short tobacco, e.g., fragmentized shreds of tobacco leaf laminae. It follows that, in many if not most instances, the quality of cigarettes or other smokers' products is far from being acceptable or entirely satisfactory because the mixture of tobacco particles is likely to vary from cigarette to cigarette or from a short first series to the next series of successively produced cigarettes.

OBJECTS OF THE INVENTION

An object of the invention is to provide a method which renders it possible to homogenize inhomogeneous accumulations of tobacco parts in a small area, to a desired degree of homogeneousness and without appreciable comminution of and/or other damage to tobacco parts.

Another object of the invention is to provide a method which renders it possible to homogenize a stream or another accumulation of tobacco parts to a desired degree irrespective of the absence of homogeneousness in the accumulation.

A further object of the invention is to provide a method which renders it possible to thoroughly homogenize a stream of tobacco parts in a cigarette rod making machine during advancement of tobacco parts from a conventional silo toward a shredding machine.

An additional object of the invention is to provide a method which can be resorted to for homogenization of a stream or another accumulation of tobacco parts wherein bunches, clumps or tufts of identical tobacco parts alternate with partly or fully homogenized sections of the stream.

Still another object of the invention is to provide a novel and improved apparatus which can be utilized for the practice of the above outlined method.

A further object of the invention is to provide a modular apparatus which can be modified to increase or reduce the homogenizing action upon an accumulation of inhomogeneous tobacco parts.

Another object of the invention is to provide an apparatus which can be assembled of available parts and/or of slightly modified conventional parts.

An additional object of the invention is to provide the apparatus with novel and improved means for homogenizing an inhomogeneous accumulation of tobacco parts in one, two or more stages.

Still another object of the invention is to provide an apparatus which can be installed in existing cigarette rod making or like machines to increase the homogeneousness of inhomogeneous accumulations of tobacco parts between selected stations preceding the rod forming station.

An additional object of the invention is to provide a tobacco processing machine embodying one or more homogenizing apparatus of the above outlined character.

SUMMARY OF THE INVENTION

One feature of the present invention resides in the provision of a method of homogenizing an inhomogeneous accumulation of tobacco parts. The method comprises the steps of feeding the accumulation of tobacco parts onto a support having a plurality of openings so that the tobacco parts pass through and descend below the openings, and positioning a conveyor beneath the support so that the conveyor intercepts the descending tobacco parts. The accumulation can constitute a stream of tobacco parts, and the feeding step can include advancing the stream along an elongated path toward the support. The stream can contain at least two different types of tobacco parts (for example, Virginia, Burley and Oriental tobacco, natural tobacco leaves or tobacco leaf laminae, reconstituted tobacco and substitute tobacco, flavored and unflavored tobacco and/or others).

The method can further comprise the step of arraying the openings of the support in groups which are disposed in or close to a common plane and in a plurality of different directions, e.g., longitudinally and transversely of a substantially rectangular support.

The method preferably further comprises the step of agitating the support.

Still further, the method can comprise the step of feeding intercepted tobacco parts onto a second support having a plurality of openings so that the tobacco parts pass through and descend below the openings of the second support. For example, the conveyor can be utilized as, or can include, the second support. Such method preferably further comprises the step of agitating (particularly vibrating) at least one of the plural supports to thus promote the passage of tobacco parts through the respective openings and to ensure that the tobacco parts on the agitated support can or must advance in a desired direction. Still further, the method can comprise the step of placing a second conveyor beneath the second support so that the second conveyor intercepts the descending tobacco parts beneath the openings of the second support.

The feeding step can comprise advancing tobacco parts in a first direction along the respective support, and the conveyor beneath such support can be driven to advance tobacco parts in a second direction substantially or exactly counter to the first direction.

Another feature of the present invention resides in the provision of an apparatus for homogenizing an inhomogeneous accumulation of tobacco parts. The improved apparatus comprises a support having a plurality of openings, means for feeding the accumulation of tobacco parts onto the support so that the tobacco parts pass through and descend beneath the openings, and a conveyor which is disposed beneath the support and serves to intercept the descending tobacco parts. The apparatus can further comprise means for agitating (for example, vibrating) at least one of the components including the support and the conveyor. Agitation of the support promotes the passage of tobacco parts through the openings and can ensure that the support advances the tobacco parts in a desired direction before the parts come into register with and enter the openings in the support.

The conveyor can include a second support which is provided with openings so that the descending tobacco parts can pass through and can descend below the openings of such second support.

The feeding means can include means for advancing to the support a stream-like accumulation of tobacco parts in a first direction, and the conveyor can comprise means for advancing intercepted tobacco parts in a second direction at least substantially counter to the first direction.

Each support can form part of or can constitute a vibratory trough type, roller or grate conveyor.

The apparatus can comprise means (e.g., one or more eccentrics) for agitating the support or supports.

In accordance with one presently preferred embodiment, the apparatus comprises a first support, a first conveyor beneath the first support, a second support having openings and positioned to receive tobacco parts from the first conveyor, and a second conveyor positioned to intercept tobacco parts which pass through and descend below the openings of the second support. The first and/or the second support can constitute or can form a component of a conveyor which advances tobacco parts in a first direction, the the conveyor beneath such support can be provided with means (e.g., a belt) for advancing intercepted tobacco parts in a second direction at least substantially counter to the first direction.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a schematic partly front elevational and partly side elevational view of a homogenizing apparatus which employs a pair of supports in the form of bottom walls or panels of vibratory troughs or trays, and a vibratory conveyor beneath each of the two supports.

DESCRIPTION OF PREFERRED EMBODIMENTS

The apparatus which is shown in the drawing comprises a so-called longitudinal mixing plant 1 of the type disclosed, for example, in U.S. Pat. No. 2,796,066 or German Pat. No. 11 20 339. The illustrated plant 1 comprises an endless belt conveyor 3 which is trained over pulleys 4 (one shown) and advances several layers (three layers *2a*, *2b*, *2c* are shown) toward the observer of the drawing. The illustrated layers *2a–2c* are vertical; however, and as shown in U.S. Pat. No. 2,796,066, the layers can be horizontal to form a stack of superimposed layers. For example, the upper reach of the conveyor 3 can carry layers of Virginia, Burley and/or Oriental tobacco and/or flavored tobacco in the form of leaves, portions of leaves, fragments of foils or sheets of reconstituted tobacco, substitute tobacco and/or others. Each of the layers *2a–2c* can be 40 centimeters long and 40 centimeters wide, the combined height of the layers *2a–2c* can be in the range of 1½ meters, and the combined width of such layers can be in the range of 3 meters.

The front or discharge end of the conveyor 3 is adjacent a system of rakes in the form of horizontal rollers 7 with entraining elements 6 in the form of pins, studs, prongs or the like. The drive means for the rollers 7 is indicated at *7a*; such drive means ensures that the entraining elements 6 remove tobacco parts from the front side of the pile of layers *2a–2c* while moving vertically or nearly vertically downwardly to thus propel the removed tobacco parts onto the upper reach of a second conveyor 8 which is driven to advance at right angles to the direction of advancement of the upper reach of the conveyor 3. The arrangement is such that the entraining elements 6 simultaneously remove tobacco parts from each of the layers *2a*, *2c* and shower the removed tobacco parts downwardly to form an elongated stream which advances to the right, as seen in the drawing. The conveyor 8 transfers successive increments of the tobacco stream onto the upper reach of a further endless belt conveyor 9. The conveyors 8 and 9 are driven in synchronism by a common driving unit 11.

In heretofore known tobacco processing plants which employ a mixing plant 1 of a similar mixing plant, the accumulation or stream of tobacco parts on the conveyor 9 is delivered directly to a shredding machine which comminutes the tobacco parts and delivers the thus obtained shreds to a drying unit (e.g., in the form of a rotary drum) wherein the moisture content of shreds is reduced to a value which is desirable for conversion of shreds into the filler of a cigarette rod.

As mentioned above, the entraining elements 6 of the rollers 7 are designed to simultaneously remove tobacco parts from each of the layers *2a–2c* (or from each of four or more layers if the number of layers on the upper reach of the conveyor 3 exceeds three). Nevertheless, the accumulations of tobacco parts on the conveyors 8 and 9 constitute inhomogeneous streams wherein clumps, bunches or tufts *2e* of identical tobacco parts alternate with sections or stretches *2d* of more or less uniformly distributed or spread out parts of two or more sorts of tobacco. In other words, in the absence of any homogenizing treatment, the stream *2d*+*2e* on the conveyor 9 would yield an inhomogeneous mixture of several types of tobacco parts which would adversely affect the quality of the rod-like tobacco filler and of cigarettes or other smokers' products containing such inhomogeneously distributed tobacco parts. Absence of a satisfactory homogenizing action ahead of the shredding machine greatly affects the taste of tobacco smoke as well as the filling power of tobacco in the cigarettes or other rod-shaped smokers' products. This is in direct contrast to the requirements for the making of high-quality smokers' products.

In accordance with a feature of the invention, the conveyor 9 serves as a means for feeding the accumulation or stream *2d*+*2e* of tobacco parts onto the upper side of a substantially rectangular support 21 which constitutes the bottom wall or panel of a trough or tray 17 in a vibratory trough conveyor 16. The support 21 is formed with groups or rows of longitudinally and transversely extending at least substantially coplanar openings or apertures 22 in the form of round or oval holes, slits or the like, and the trough or tray 17 is mounted on leaf springs 18 or other suitable resilient elements so that it can be agitated by a driven rotary eccentric 19. The eccentric 19 imparts to the trough 17 vibratory movements of such nature that the stream *2d*+*2e* which is fed by the conveyor 9 advances in the direction of arrow 23, i.e., toward the front or right-hand end *17a* of the trough 17.

As the parts of the tobacco stream *2d*+*2e* advance in the direction of arrow 23, they come into alignment with and pass through the openings 22 to descend by gravity onto a conveyor 26 which is installed beneath the trough 17. The sifting or trickling operation is completed not later when the leader of the stream *2d*+*2e* reaches the front end *17a* of the trough 17.

The conveyor 26 is a vibratory conveyor having a platform or trough 28 which is mounted on springs 29 and is agitated by a driven rotary eccentric 31 in order to advance the once homogenized stream *2d'* in the direction of arrow 27, i.e., at least substantially counter to the direction (arrow 23) of advancement of the stream *2d*+*2e* along the elongated path which is defined by the conveyor 9 and trough 17. The illustrated conveyor 26 can be replaced with a different conveyor, e.g., with a conventional endless belt conveyor; however, a conveyor 26 in the form of a vibratory trough, tray or platform conveyor is preferred at this time because the particles of the once homogenized stream 2d' undergo additional homogenizing treatment during advancement in the direction of arrow 27 to leave the conveyor 26 at the left-hand end 28a of the platform 28.

It has been found that the combined homogenizing action of the support 21 and conveyor 26 is particularly satisfactory if the speed of advancement of tobacco parts on the support 21 in the direction of arrow 23 is selected to ensure that the interval of time which is required by a tobacco part to advance from the rear end to the front end 17a of the trough 17 equals or approximates the interval that is required by a bunch, clump or tuft 2e of non-uniformly distributed tobacco parts to advance through a distance corresponding to that between two successive clumps 2e on the upper reach of the conveyor 9. The thickness of the stream 2d+2e on the support 21 decreases in the direction of arrow 23 (i.e., toward the front end 17a of the trough 17), and the thickness of the once homogenized stream 2d, on the platform 28 of the conveyor 26 increases in the direction of arrow 27.

The platform 28 of the conveyor 26 can be replaced with a support corresponding to the support 21, i.e., the platform can be provided with openings or apertures to compel the tobacco parts descending below the support 21 to trickle through a second set of openings on their way toward a conveyor beneath the conveyor 26. Instead, and in order to render it possible to resort to a modular design of the homogenizing means in the illustrated apparatus, the left-hand end 28a of the platform 28 in the conveyor 26 of the illustrated embodiment of the apparatus delivers successive increments of the once homogenized stream 2d' onto the substantially horizontal support 41 of a second vibratory trough type conveyor 36 which is or can be identical with the conveyor 16 and includes springs 38 for the trough 37 and an eccentric 39 which is driven to agitate the trough 37 and to cause the stream 2d' to advance in the direction of arrow 43, i.e., toward the front end 37a of the trough 37. The support 41 is provided with coplanar or nearly coplanar openings 42 which can but need not be distributed or arrayed in the same way as the openings 22 in the support 21 of the conveyor 16. Furthermore, the configuration of the (circular, oval, slit-shaped or otherwise configurated) openings 42 in the support 41 can but need not match the shape or configuration of openings 22 in the support 21. The same holds true for the sizes of the openings 22 and 42.

Tobacco parts which form the stream 2d' and pass through the openings 42 descend onto the platform 58 of a conveyor 56 which is or can be identical with the conveyor 26 and is located beneath the support 41. The platform 58 is mounted on springs 59 and is agitated by a driven rotary eccentric 61 in order to advance the twice homogenized stream 2d'' in the direction of arrow 57, i.e., counter to the direction (arrow 43) of advancement of the stream 2d' on the support 41. Those components of the stream 2d'' which reach the front end of the platform 58 are admitted into a shredding machine, not shown, or into another unit of the tobacco processing machine which embodies the improved homogenizing apparatus.

The second conveyor 56 can be replaced with a simple belt conveyor; however, a vibratory conveyor 56 is preferred at this time because the parts of the tobacco stream 2d'' are homogenized again during advancement in the direction of arrow 57.

It has been found that the stream 2d+2e undergoes a highly satisfactory homogenizing treatment in an apparatus which includes only a single support (such as the support 21) and a conveyor (such as the conveyor 26) which intercepts the tobacco parts descending beneath the openings (22) of the single support. The provision of two supports (i.e., homogenizing in two successive steps or stages) normally suffices to ensure a practically complete homogenization of the stream ahead of the shredding or another processing station in a cigarette rod making or other tobacco processing machine. Nevertheless, the apparatus can be furnished with three or even more modules each of which includes a first conveyor with an apertured support and a second conveyor beneath the apertured support. In addition, and as already mentioned above, the compactness of the improved apparatus can be enhanced if the platform 28 of the conveyor 26 is replaced with an apertured support so that the stream 2d+2e undergoes two successive homogenizing treatments before its parts reach the discharge end of the apertured support replacing the platform 28. This would be tantamount to replacing the conveyor 26 with the vibratory trough conveyor 36 and mounting the transplanted conveyor 36 in such a way that its support 41 would advance the parts of the stream 2d' in the direction of arrow 27.

It is further within the purview of the invention to replace the vibratory trough conveyor 16 and/or 36 with a different vibratory conveyor, e.g., with a conveyor having a support in the form of one or more apertured grates or a support in the form of rollers which define openings for the passage of parts of the tobacco stream 2d+2e, 2d' or 2d''.

The vibratory support or supports of the improved apparatus spread out the clumps, bunches or tufts 2e of identical tobacco parts during advancement of the stream 2d+2e or 2d, along the respective support. Additional spreading of the bunches is effected by the conveyor or conveyors (26, 56) beneath the support or supports (21, 41). The number of homogenizing operations can be repeated as often as necessary in order to obtain a stream of desired homogeneousness.

An important advantage of the improved method and apparatus is that the treatment of tobacco parts in the course of the homogenizing operation is gentle, i.e., the treatment does not involve the making of a relatively high percentage of short tobacco.

Another important advantage of the improved method and apparatus is that the homogenizing operation or operations can be completed in a small area and at the same rate at which the stream 2d+2e is formed. Moreover, the homogenizing action is highly satisfactory irrespective of the extent or lack of homogeneousness of the stream 2d+2d which is being supplied to the first support 21 (or to the only support, depending on the selected design and size of the apparatus). The homogenizing operation is highly satisfactory regardless of the size of clumps, bunches or tufts 2e in the stream on the conveyor 9 or on or in another device which is selected to feed the accumulation of inhomogeneous tobacco parts to the first support.

A further important advantage of the improved method and apparatus is that the homogenizing means can be assembled of conventional and slightly modified conventional conveyors, particularly vibratory conveyors. Thus, all that is necessary to convert one or more standard vibratory trough conveyors into conveyors of the type shown at 16 and 36. This reduces the cost of the improved apparatus since the converted conventional vibratory conveyor or conveyors can be mounted to receive tobacco from a standard plant such as the one shown at 1. German Pat. No. 1 072 171 to Bauer et al. discloses a multi-level system of vibratory conveyors for loosening of tobacco bales.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of homogenizing an inhomogeneous accumulation of tobacco parts, comprising the steps of feeding the accumulation onto a support having a plurality of openings so that all of the tobacco parts pass through and descend below the openings; and positioning a conveyor beneath the support so that the conveyor intercepts the descending tobacco parts.

2. The method of claim 1, wherein the accumulation is a stream of tobacco parts and said feeding step comprises advancing the stream along an elongated path.

3. The method of claim 2, wherein the stream contains at least two different types of tobacco parts.

4. The method of claim 1, further comprising the step of arraying the openings of the support in groups extending in or close to a common plane and in a plurality of different directions.

5. The method of claim 1, further comprising the step of agitating the support.

6. The method of claim 1, further comprising the step of feeding intercepted tobacco parts onto a second support having a plurality of openings so that the tobacco parts pass through and descend below the second support.

7. The method of claim 6, further comprising the step of utilizing the conveyor as said second support.

8. The method of claim 6, further comprising the step of agitating at least one of the supports to thus promote the passage of tobacco parts through the respective openings.

9. The method of claim 6, further comprising the step of positioning a second conveyor beneath the second support so that the second conveyor intercepts the descending tobacco parts.

10. The method of claim 9, further comprising the step of agitating at least one of the supports.

11. The method of claim 1, wherein said feeding step comprises advancing tobacco parts along the support in a first direction and further comprising the step of driving the conveyor in a second direction at least substantially counter to said first direction.

* * * * *